US011910906B1

(12) United States Patent
Lee

(10) Patent No.: US 11,910,906 B1
(45) Date of Patent: Feb. 27, 2024

(54) NAIL POLISH CONTAINER

(71) Applicant: Young Hoon Lee, Glen Head, NY (US)

(72) Inventor: Young Hoon Lee, Glen Head, NY (US)

( * ) Notice: Subject to any disclaimer, the term of this patent is extended or adjusted under 35 U.S.C. 154(b) by 0 days.

(21) Appl. No.: 17/989,530

(22) Filed: Nov. 17, 2022

(51) Int. Cl.
*A45D 34/04* (2006.01)
*A45D 40/26* (2006.01)
*A46B 11/00* (2006.01)

(52) U.S. Cl.
CPC ..... *A45D 34/045* (2013.01); *A46B 11/002* (2013.01); *A45D 40/265* (2013.01)

(58) Field of Classification Search
CPC .. A45D 34/045; A45D 40/265; A45D 34/046; A45D 40/267; A46B 11/002; A46B 11/0041; B01L 3/00; B01L 3/0282; B01L 3/0286
USPC ..... 401/126–130, 183–186
See application file for complete search history.

(56) References Cited

U.S. PATENT DOCUMENTS

| | | | | |
|---|---|---|---|---|
| 5,226,572 | A * | 7/1993 | Gargione | G01F 11/084 422/922 |
| 2004/0237986 | A1 | 12/2004 | Kim | |
| 2016/0295991 | A9 | 10/2016 | Lee | |
| 2017/0079407 | A1* | 3/2017 | Chen | A45D 34/04 |
| 2018/0042363 | A1* | 2/2018 | Kim | A45D 34/045 |
| 2019/0343261 | A1 | 11/2019 | Jung | |

FOREIGN PATENT DOCUMENTS

| | | | |
|---|---|---|---|
| KR | 200262434 | | 3/2002 |
| KR | 100660803 | B1 | 12/2006 |
| KR | 20080005628 | A | 1/2008 |
| KR | 100822269 | B1 | 4/2008 |
| KR | 100979966 | B1 | 9/2010 |
| KR | 200451997 | | 1/2011 |
| KR | 101789573 | B1 | 10/2017 |
| KR | 102494170 | B1 | 1/2023 |

OTHER PUBLICATIONS

Written Opinion in KR102494170B1 dated Nov. 4, 2022.

* cited by examiner

*Primary Examiner* — David J Walczak
(74) *Attorney, Agent, or Firm* — Collard & Roe, P.C.

(57) ABSTRACT

In at least one embodiment, there is a nail polish applicator for nail polish, the applicator comprising: a container body, at least one cap or lid body which is coupled to the container body. There is at least one brush comprising a shaft coupled to the cap wherein the shaft has a storage body disposed therein. There is at least one air suction unit configured to draw nail polish into the storage body. There is also a compressor comprising an elastic pressing body configured to compress the air suction unit to draw nail polish into the storage body. The compressor is coupled to the cap. The compressor comprises at least one protrusion and at least one leaf spring coupled to the cap, such that when the protrusion is pressed, it compresses the suction unit to draw nail polish into the storage body.

10 Claims, 6 Drawing Sheets

NAIL POLISH CONTAINER

BACKGROUND OF THE INVENTION

The present invention relates to nail polish containers. More specifically, when an operation button is pressed, the nail polish liquid in the container is sucked and temporarily stored before being applied to the fingernails or toenails. Therefore, the invented nail polish container prevents nail polish liquid from being excessively dribbled onto the Brush Body or repeatedly inserting and withdrawing the Brush Body into or out of the container to apply the nail polish liquid to fingernails or toenails.

In general, a nail polish container stores nail polish liquid inside its container with a bottleneck-shaped thread at the top and consist of a brush-attached support rod at the bottom center of the stopper, which is also used as a handle and fitted into the bottleneck-shaped thread.

When using conventional nail polish containers of this configuration, a user opens the handle by turning and pulls out the brush-attached support rod at the bottom of the lid and then applies the nail polish liquid solution to the fingernails or toenails by rubbing the brush provided at the bottom of the pulled-out handle.

However, conventional nail polish containers are inconvenient in that a user has to frequently apply nail polish liquid to the brush provided at the bottom of the support rod when applying nail polish liquid to fingernails or toenails for caring. In addition, a user had to repeat the process of frequently inserting or withdrawing the brush in and out of the container to apply the nail polish liquid to the brush. Conventional containers incur disadvantages in this process, including cases where the nail polish liquid absorbed in the brush accidentally gets on hands or clothes.

Various techniques have been devised to solve these disadvantages of such conventional nail polish containers.

For example, a nail-polishing application, the registered utility no. 20-0262434, has been devised. As a nail care device which applies nail polish liquid to fingernails or toenails, this product is mainly formed with 1) a Container Body that stores the nail polish liquid and is compressed by external pressure to discharge the nail polish liquid through the outlet provided at one end and 2) a first female thread on the inner periphery of the lower part, which connected to the first male thread on the top of the Container Body. A tubular-shaped connecting member with a tapered brush-rod insertion groove protruding from the upper portion of the container is coupled to the brush-rod insertion groove of the connecting member by fitting. The product is structured with several additional parts: 1) a brush rod with a brush-connecting groove of a specific shape to install the brush on the top; 2) a plurality of nail-polish outlet holes to eject specific amounts of nail polish liquid through the brush-connecting groove from the inside bottom of the brush rod, 3) a specifically-shaped lid, screwed to a second female thread formed inside the top of the connecting member, which surrounds the brush rod and has specific amounts of nail polish liquid embedded to prevent the brush from hardening. This product is designed to discharge a certain amount of nail polish liquid through the brush rod attached to the top, allowing more convenient and manageable nail polishing.

However, there is also a problem with this existing technique. When applying the nail polish liquid to fingernails or toenails, a user presses the container to deliver the nail polish liquid on the brush and then turns the container over. Therefore, the brush is positioned downward, and the nail polish liquid in the container leaks out to the brush side when the container is turned upside down.

In addition, since a user has to press the Container Body holding the nail polish liquid to deliver the nail polish liquid to the brush, if the pressure of the container is relatively strong and not carefully controlled, an excessively amount of nail polish liquid tends to be extracted to the brush.

SUMMARY

In this invention, an Elastic Pressing Body is provided on the Lid Body covering the container. The nail polish liquid in the container is sucked and temporarily stored in the Storage Body by pressing this Elastic Pressing Body. After removing the Lid Body from the container, press the Elastic Pressing Body again to transfer the temporarily stored nail polish liquid to the Brush Body so that it is absorbed in the Brush Body.

The present invention aims to provide nail polish containers which can significantly improve usability and convenience by 1) preventing excessive nail polish liquid from being discharged by delivering a certain amount of nail polish liquid to the Brush Body and 2) making unnecessary the actions of repeatedly inserting and withdrawing the Brush Body in and out of the container by using the nail polish liquid stored in the Storage Body when applying to fingernails or toenails.

As a means to attain the above purpose, a nail polish container of the present invention is primarily composed of a nail polish liquid Container Body, a Lid Body covering the top of the Container Body, and a Brush Body applying the nail polish liquid from the Container Body to fingernails or toenails. The Brush Body is provided with a Storage Body for storing the nail polish liquid, an Air Suction Unit in the Lid Body interlinked with the Storage Body, and an Elastic Pressing Body. When the Air Suction Unit is pressed and stopped, the air inside the Storage Body is sucked into the Air Suction Unit, and the nail polish liquid contained in the Container Body is supplied to the Storage Body and stored. After the Lid Body is separated from the Container Body, when the Elastic Pressing Body is pressed, the nail polish liquid supplied to the Storage Body is discharged and absorbed in the Brush Body.

In addition, the Brush Body is provided with a brush at the bottom of the inner Brush Space and brush support with a hollow inside. The inside of the Storage Body is provided as a storage, a Suction Inlet located in the Brush Space is interlinked with the storage at the lower end, and a Fitting Jaw is at the upper end.

The Air Suction Unit, elastic rubber or silicone material, is provided with a Fitting Groove into which the Fitting Jaw of the Storage Body is fitted and an Air Compression Space is interlinked with the storage of the Storage Body, respectively. The Elastic Pressing Body is provided with an Elastic Hook that covers the top of the Lid Body and a Pressing Protrusion at both lower ends of the Elastic Hooks and is in close contact with the outer surface of the Air Suction Unit.

In addition, the Lid Body is provided with a Stopping Jaw, and the lower end of the Air Suction Unit is provided with a Stopping Flange for fixing the Air Suction Unit to the Lid Body by being hooked on the Stopping Jaw.

In addition, the upper end of the Lid Body is provided with a Seating Hole in which the Elastic Hook of the Elastic Pressing Body is seated. Fixing holes are provided on both sides of the Seating Holes, respectively. An Elastic Hook seated in the Seating Hole and a Receiving Space in which the Pressing Protrusion is positioned and received on the elastic hanger are provided on the outer surfaces of both sides of the Lid Body. Fixing protrusions for fixing the Elastic Pressing Body to the Lid Body by being fitted into the Fixed Hole are respectively provided on the inner surface of the Elastic Hook of the Elastic Pressing Body.

In the present invention, the nail polish liquid in the Container Body is sucked into the Storage Body and stored by the air pressure difference generated when the Elastic Pressing Body is pressed and released. After the Container Body and Lid Body are separated, when the Elastic Pressing Body is pressed, a certain amount of the nail polish liquid stored in the Storage Body is discharged to the Brush Body to be absorbed into the brush, making it easier for a user to apply the nail polish liquid to fingernails or toenails.

This process prevents excess nail polish liquid from being delivered to the Brush Body and makes unnecessary the repeated action of inserting or withdrawing the Brush Body into or out of the container to apply the nail polish liquid to fingernails or toenails.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

In addition to the above purposes, other objectives and features of the present invention are illustrated more explicitly below through the description of the embodiments by referring to the accompanying figures. Unless defined otherwise, all terms used herein, including technical and scientific terms, have the same meaning as commonly understood by one of ordinary skill in the art to which the present invention belongs. Terms such as those defined in a commonly used dictionary should be interpreted as having a meaning consistent with the meaning in the context of the related art.

Unless explicitly defined in this application, terms are not to be construed in an ideal or overly formal sense.

The following describes the nail polish containers based on the embodiments of the present invention in more detail by referring to the attached figures.

Figure 1:
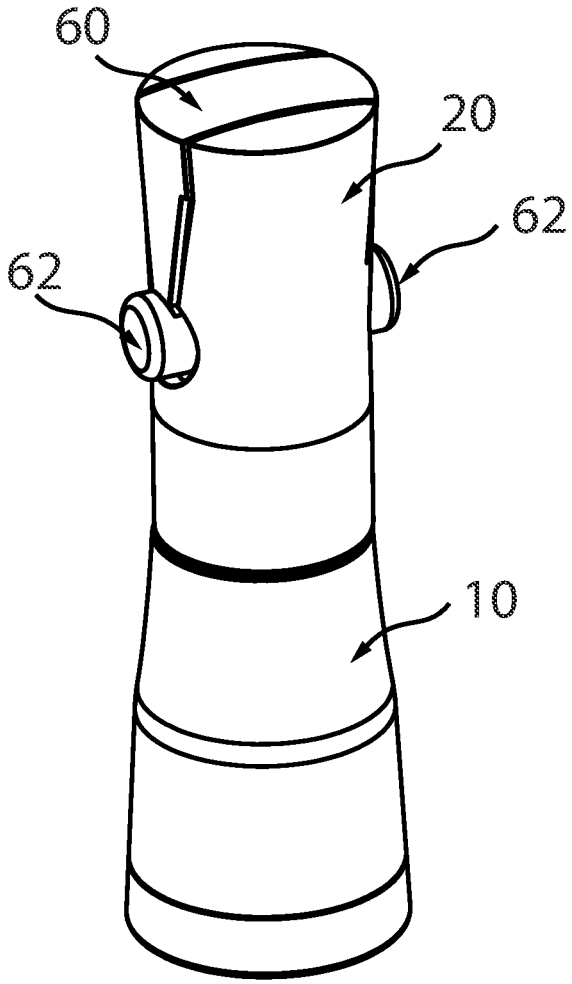
FIG. 1: A perspective view showing one side of the nail polish container of the present invention.
Figure 2:
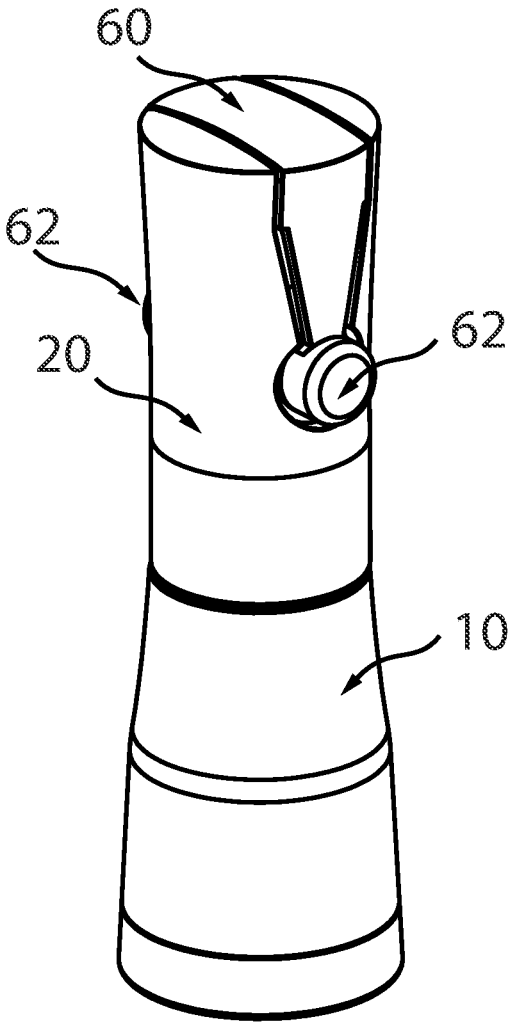
FIG. 2: A perspective view showing the other side of the nail polish container of the present invention.

As illustrated, the present invention as shown in FIGS. 1 and 2 relates to a nail polish container consisting of a Container Body containing nail polish liquid (10), a Lid Body (20) covering the top of the Container Body (10), and a Brush Body (30) to apply the nail polish liquid contained in the Container Body (10) to fingernails or toenails. The Brush Body (30) is provided with a Storage Body (40) for storing the nail polish liquid, an Air Suction Unit (50) in the Lid Body (20) interlinked with the Storage Body (40), and an Elastic Pressing Body. When the Air Suction Unit (50) is pressed and stopped, the air inside the Storage Body is sucked into the Air Suction Unit (50), and the nail polish liquid contained in the Container Body (10) is supplied to the Storage Body (40) and stored. After the Lid Body (20) is separated from the Container Body (10), when the Elastic Pressing Body (60) is pressed, the nail polish liquid supplied to the Storage Body (40) is discharged and absorbed in the Brush Body (30).

When the Elastic Pressing Body (60) of the illustrated present invention is pressed and released, the Air Suction Unit (50) is also pressed and released to generate air pressure difference. Then, the nail polish liquid contained in the Container Body (10) is stored by suction of the Air Suction Unit (50) toward the Storage Body (40) interlinked with the Air Suction Unit (50).

In addition, after the Lid Body (20) is separated from the Container Body (10) while the nail polish liquid is sucked and stored in the Storage Body (40), when the Elastic Pressing Body (60) is pressed, the Air Suction Unit (50) is pressed while the air inside the Air Suction Unit (50) is transferred to the Storage Body (40). As a result, the nail polish liquid sucked and stored in the Storage Body (40) is absorbed on the Brush Body (30) to apply the nail polish liquid to fingernails or toenails.

Here, a user can control the discharge of the nail polish liquid by releasing the Elastic Pressing Body (60) as the nail polish liquid sucked and stored in the Storage Body (40) is blocked from being delivered to the Brush Body (30). When the Elastic Pressing Body (60) is pressed again, the nail polish liquid is delivered to the Brush Body (30) again. Therefore, the nail polish liquid stored in the Storage Body (40), when applied to fingernails or toenails, can be sufficiently applied. As a result, it is unnecessary to repeatedly insert and withdraw the Brush Body (30) in and out of the Container Body (10).

In addition, since the nail polish liquid stored in the Storage Body (40) is not transferred to the Brush Body (30) before the Elastic Pressing Body (60) is pressed, it is possible to prevent the nail polish liquid from getting on hands or clothes. A user can easily check the amount of nail polish liquid applied to the Brush Body (30) with the naked eye by pressing the Elastic Pressing Body (60) and, therefore, can apply the liquid to one fingernail or toenail each time the Elastic Pressing Body (60) is pressed. This structure helps control the proper discharge of the nail polish liquid and prevents the liquid from hardening before it is applied to other fingernails or toenails.

Figure 4:
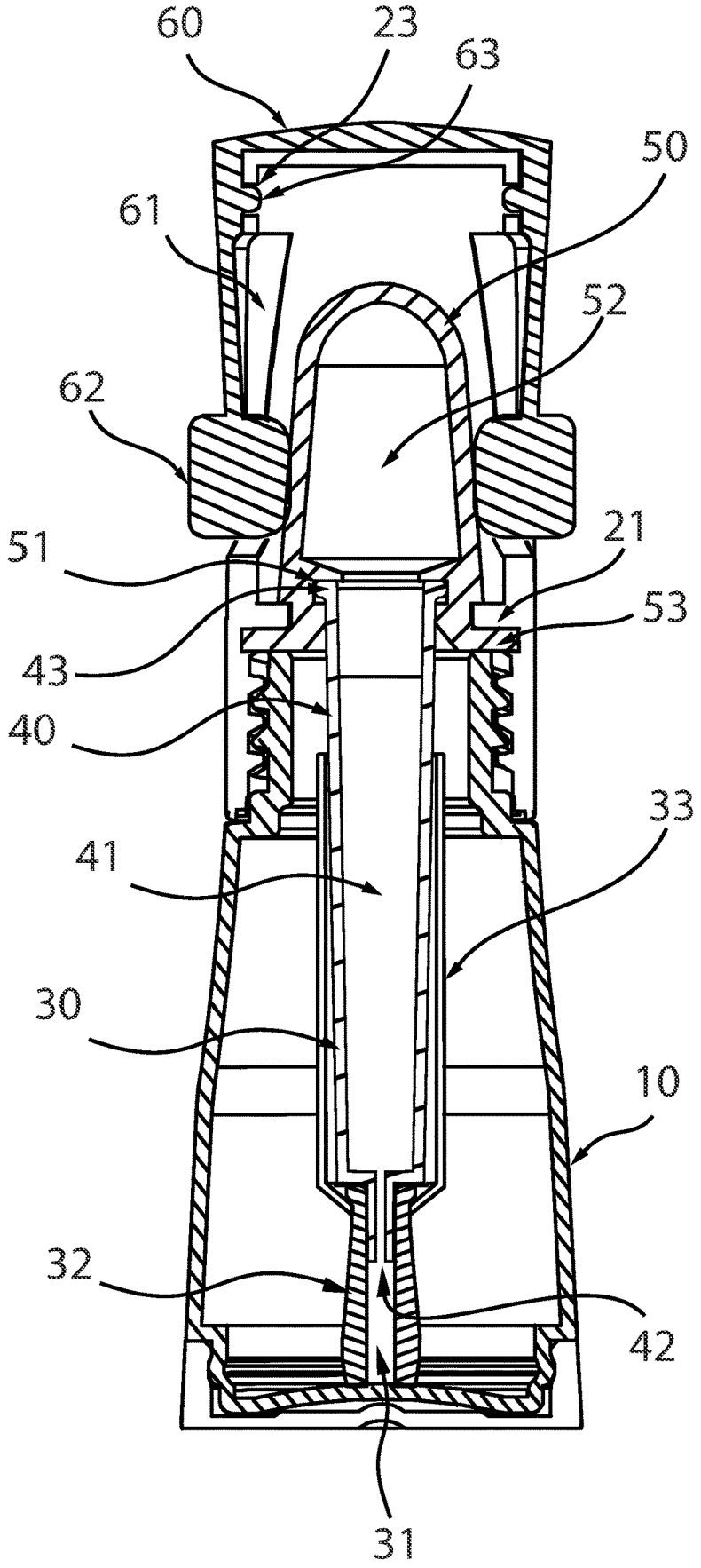
FIG. 4: A block figure showing the configuration of the nail polish container of the present invention.

The Brush Body (30) of the present invention is provided with a brush (32) having a Brush Space (31) on the inside and brush support (33) having a hollow interior. As shown in FIG. 4, since the upper end of the brush support (33) is fitted closely to the lower end of the Lid Body (20), the Brush Body (30) is prevented from being separated from the Lid Body (20).

In addition, the present invention is provided with storage (41) inside the Storage Body (40), the Suction Inlet (42) located in the Brush Space (31) interlinked with the storage (41) at the bottom, and a Fitting Jaw (43) at the top.

In this invention, the Air Suction Unit (50), elastic rubber or silicone material, is provided with a Fitting Groove (51)

into which the Fitting Jaw (43) of the Storage Body (40) is fitted and an Air Compression Space (52) is interlinked with the storage (41) of the Storage Body (40), respectively.

As described above, since the Fitting Jaw (43) of the Storage Body (40) is seated in the Fitting Groove (51) of the Air Suction Unit (50), the separation of the Air Suction Unit (50) from the Storage Body (40) is prevented.

Figure 3:
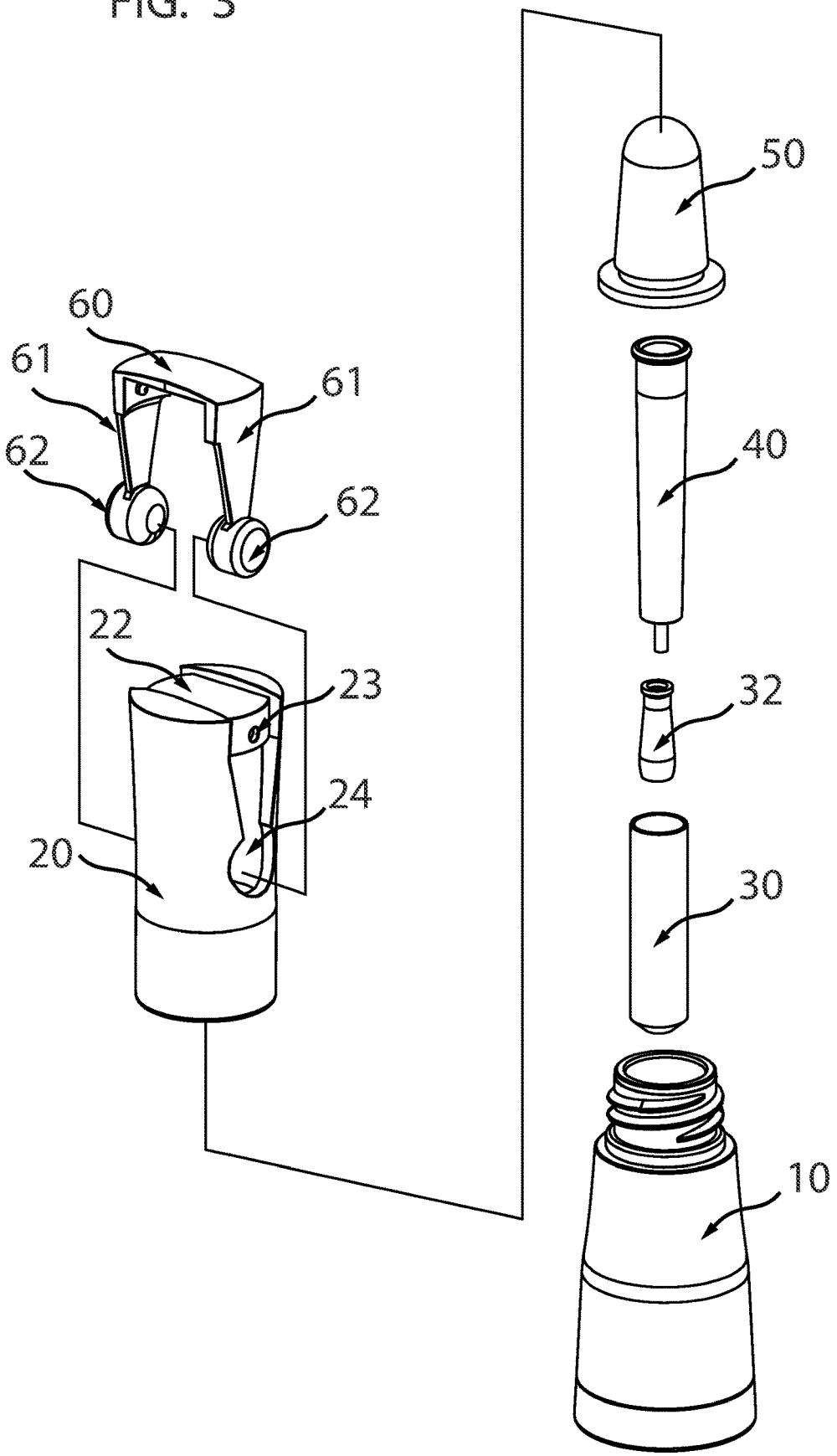
FIG. 3: An exploded perspective view showing the configuration of the nail polish container of the present invention.

In this invention, as shown in FIG. 3 the Elastic Pressing Body (60) is provided with an Elastic Hook (61) that covers the top of the Lid Body (20) and a Pressing Protrusion (62) at both lower ends of the Elastic Hooks (61) and is in close contact with the outer surface of the Air Suction Unit (50).

Figure 6:
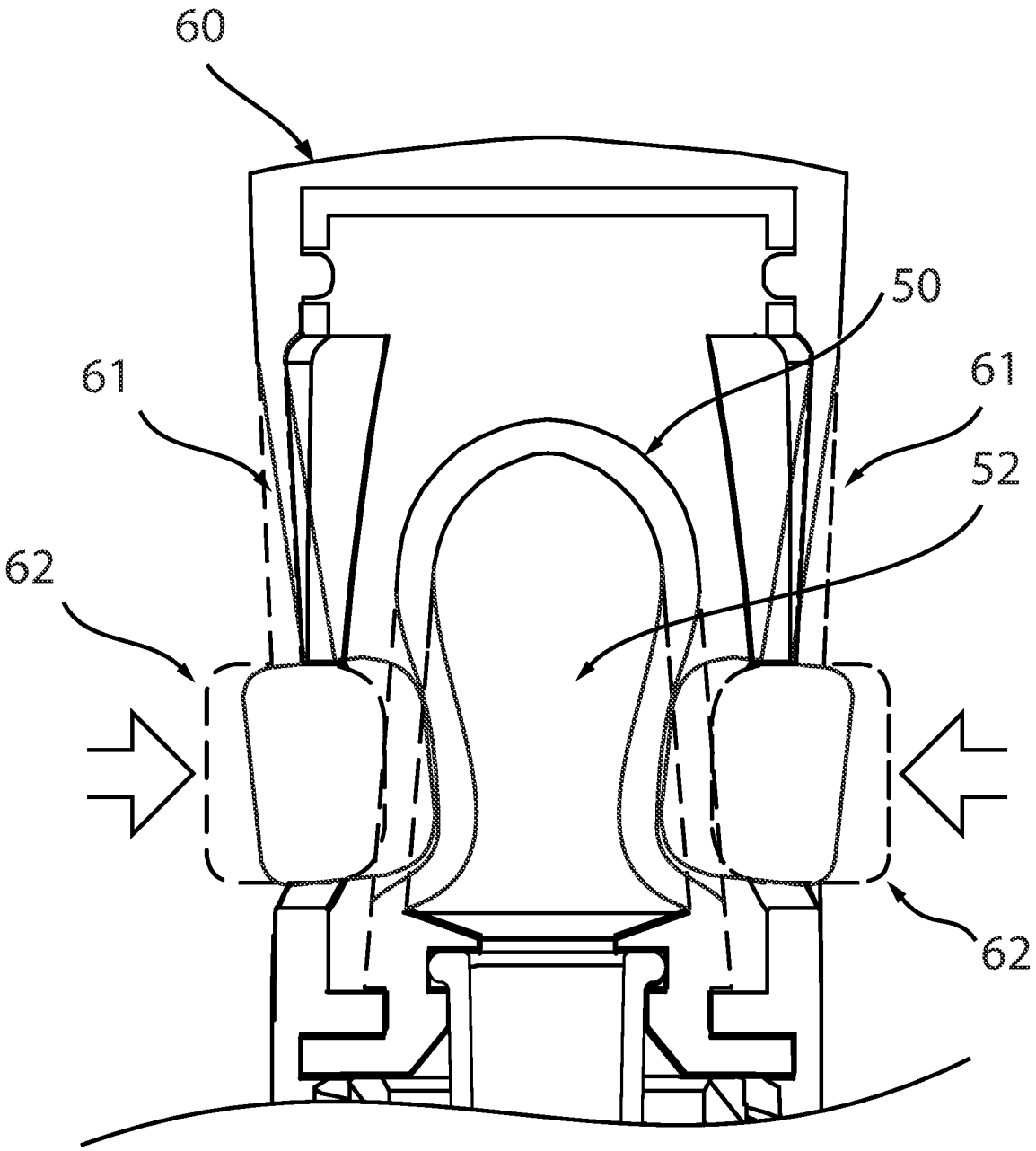
FIG. 6: A functional figure showing the state of operation of the components of the nail polish container of the present invention

When the Pressing Protrusion (62) provided at the bottom of both sides of the Elastic Hook (61) of the Elastic Pressing Body (60) is pressed in the present invention, respectively, both sides of the Air Suction Unit (50) are pressed by the Pressing Protrusion (62), as shown in FIG. 6.

Accordingly, the air inside the Air Compression Space (52) of the Air Suction Unit (50) is introduced into the storage (41) of the Storage Body (40). When the Pressing Protrusion (62) is released, the Air Suction Unit (50) made of elastic rubber or silicone material returns to its original position. Here, the air inside the storage (41) of the Storage Body (40) is instantaneously introduced into the Air Compression Space (52), which generates air pressure difference inside the storage (41) of the Storage Body (40) and the Air Compression Space (52) of the Air Suction Unit (50).

In addition, due to the air pressure difference inside the storage (41) of the Storage Body (40) and the Air Compression Space (52) of the Air Suction Unit (50), the nail polish liquid contained in the Container Body (10) passes through the Suction Inlet (42) interlinked with the storage (41) through the Brush Space (31) of the Brush Body (30) and is sucked into the storage (41) and stored.

Here, as shown in FIG. 4, the storage (41) of the Storage Body 40 is provided along the longitudinal direction of the Storage Body (40). Therefore, due to the air pressure difference inside the storage (41) of the Storage Body (40) and the Air Compression Space (52) of the Air Suction Unit (50), the nail polish liquid contained in the Container Body (10) is sucked into the storage (41) of the Storage Body (40) and stored.

When the Lid Body (20) is separated from the Container Body (10) after the nail polish liquid is sucked into and stored in the storage (41) of the Storage Body (40), Lid Body (20), Elastic Pressing Body (60) and Air Suction Unit (50), Storage Body (40), and Brush Body (30) are simultaneously separated from the Container Body (10). After the Lid Body (20) is separated from the Container Body (10), when the Pressing Protrusion (62) of the Elastic Pressing Body (60) is pressed, the Air Suction Unit (50) is also pressed. Accordingly, the nail polish liquid sucked and stored in the Storage (41) is discharged through the Suction Inlet (42) and absorbed into the Brush (32) of the Brush Body (30) in the Brush Space (31), where the suction inlet (42) is located.

Here, a user checks the amount of nail polish liquid to apply one fingernail or toenail, releases the Pressing Protrusion (62) to stop discharging the nail polish liquid, and applies the nail polish liquid absorbed in the brush (32) to the fingernail or toenail.

The Lid Body (20) of the present invention is provided with a Stopping Jaw (21). Also, at the lower end of the Air Suction Unit (50), a Stopping Flange (53) for fixing the Air Suction Unit (50) to the Lid Body (20) by being hung on the Stopping Jaw (21) is provided.

Accordingly, when the Lid Body (20) is separated from the Container Body (10), the Air Suction Unit (50) is prevented from being separated from the Container Body (10) and Lid Body (20), although the Air Suction Unit (50) is pressed at the same time when the Pressing Protrusion (62) is pressed.

Figure 5:
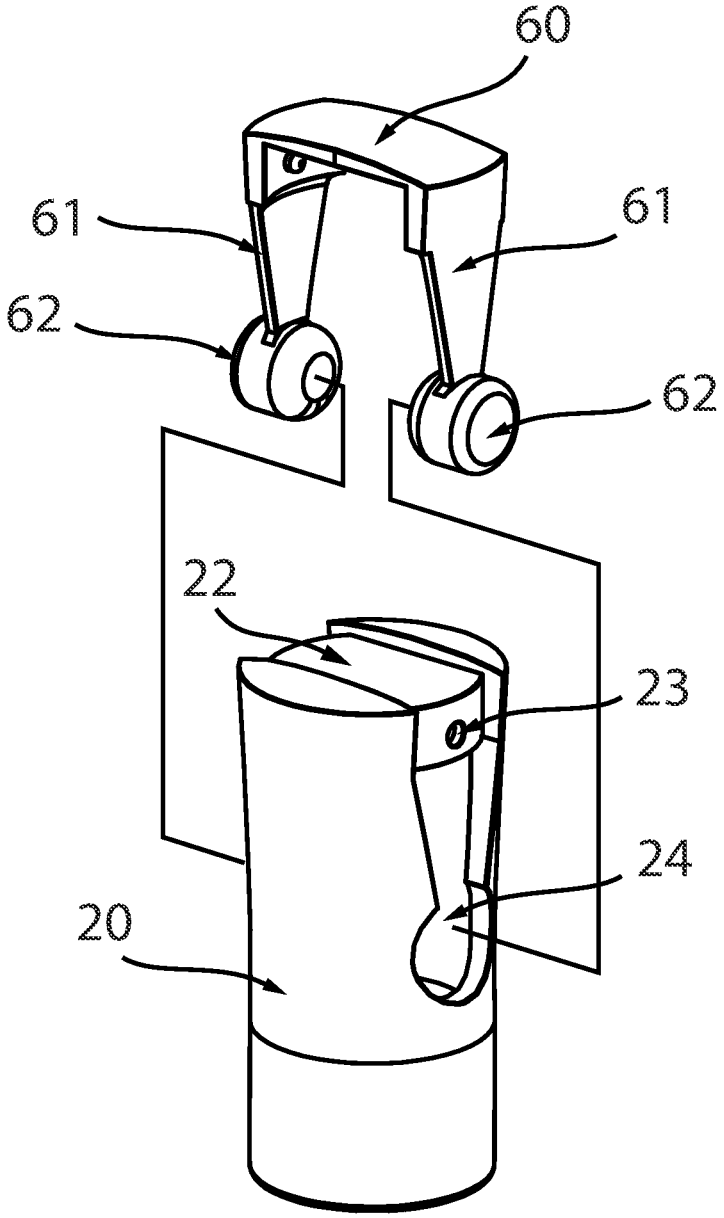
FIG. 5: An exploded perspective view showing the components of the nail polish container of the present invention

As shown in FIG. 5, the top of the Lid Body (20) of the present invention is provided with a Seating Hole (22) on which the Elastic Hook (61) of the Elastic Pressing Body (60) is seated. In addition, the Fixed Hole (23) is provided on both sides of the Seating Hole (22).

In addition, on both outer surfaces of the Lid Body (20), the Elastic Hook (61) seated in the Seating Hole (22) and the Receiving Space (24) is provided where the Pressing Protrusion (62) provided with the Elastic Hook (61) is located and received. The Elastic Hook (61) inside the Elastic Pressing Body (60) is provided with a Fixed Protrusion (63) for fixing the Elastic Pressing Body (60) to the Lid Body (20) by being fitted into the Fixed Hole (23).

In the present invention, the Elastic Hook (61), seated in the Seating Hole (22) provided at the top of the Lid Body (20) and hung, is inserted onto the Fixed Protrusion (63) provided on the inner surface of the Elastic Hook (61) in the fixed hole (23) provided in the Seating Hole (22). Therefore, the separation of the Lid Body (20) and the Elastic Pressing Body (60) is prevented, and the Air Suction Unit (50) can be easily released by the self-elasticity of the Pressing Protrusion (62) pressed from the Air Suction Unit (50).

In addition, the Receiving Space (24) of the Lid Body (20) and the Elastic Hook (61) of the Elastic Pressing Body (60) of the present invention are each provided in a gorge key type that is tapered from the upper side to the lower side.

Accordingly, when the outside of the Pressing Protrusion (62) is pressed, the Pressing Protrusion (62) is drawn into the Receiving Space (24) and quickly returns to its original position when released.

In at least one embodiment, there is a nail polish applicator for nail polish, the applicator comprising: a container body (10), at least one cap or lid body 20 which is coupled to the container body (10). There is at least one brush (31) comprising a shaft (30) coupled to the cap wherein the shaft has a storage body (40) disposed therein. There is at least one air suction unit (50) configured to draw nail polish into the storage body. As shown in FIG. 6, there is also at least one compressor (60) comprising an elastic pressing body configured to compress the air suction unit (50) to draw nail polish into the storage body. The compressor is coupled to the cap (20). The compressor (60) comprises at least one protrusion (62) and at least one leaf spring (61) coupled to the cap (60), such that when the protrusion is pressed, it compresses the suction unit to draw nail polish into the storage body (40).

In at least one embodiment the cap (20) is made from substantially rigid material.

In addition, in at least one embodiment of compressor (60) comprises at least two protrusions (62) disposed substantially opposite each other on the cap (20). In at least one embodiment the air suction unit comprises a rubber bladder (50). In at least one embodiment the cap (20) comprises a receiving hole (24) for receiving the compressor. In at least one embodiment, the compressor (60) comprises a u-shaped bracket. In at least one embodiment the at least one suction inlet (42) is coupled to the storage body (40). In at least one embodiment the leaf spring or arm (61) is coupled to the cap (20) and is positioned substantially flush along an outer surface of the cap (20). In at least one embodiment the protrusion (62) is shaped in a substantially cylindrical manner. In at least one embodiment the compressor (60) comprises a substantially u-shaped bracket (61) has protrusions (62) positioned on each end of the bracket wherein the u-shaped bracket (61) is positioned on an outside region of the cap (20).

As described above, the present invention has been described by specific matters such as specific components and limited embodiment examples and figures primarily to help the overall understanding. The present invention is not limited to the above embodiment examples. Various modifications and variations are possible from these descriptions by those of ordinary skill in the art to which the present invention pertains. In addition, the characteristic technical configuration of the present invention can be applied to general cosmetic containers.

Therefore, the idea of the present invention should not be limited to the described embodiments, and not only the claims described below, but also all of the claims and equivalents or comparable modifications to the claims belong to the scope of the idea of the present invention.

CODES

10: Container Body
20: Lid Body
21: Stopping Jaw
22: Seating Hole
23: Fixing hole
24: Receiving Space
30: Brush Body
31: Brush Space
32: Brush
33: Brush Support
40: Storage Body
41: Storage
42: Suction Inlet
43: Fitting Jaw
50: Air Suction Unit
51: Fitting Groove
52: Air Compression Space
53: Stopping Flange
60: Elastic Pressing Body
61: Elastic Hook or arms
62: Pressing Protrusion
63: Fixed Protrusion Accordingly, while at least one embodiment of the present invention have been shown and described, it is to be understood that many changes and modifications may be made thereunto without departing from the spirit and scope of the invention as defined in the appended claims.

What is claimed is:

1. A nail polish applicator for nail polish, the applicator comprising:

a container body;

at least one cap;

at least one brush wherein the at least one brush comprises a shaft coupled to said at least one cap and wherein said at least one shaft has a storage body disposed therein;

at least one air suction unit configured to draw nail polish into the storage body;

at least one compressor configured to compress the air suction unit such that when the air suction unit expands it draws nail polish into the storage body;

wherein the at least one compressor is coupled to said at least one cap, and wherein said at least one compressor comprises at least one protrusion and at least one leaf spring coupled to the cap, such that when the protrusion is pressed, it compresses the suction unit and when the compressor is released the suction unit expands to draw nail polish into the storage body.

2. The nail polish applicator as in claim 1, wherein the cap is made from a rigid material.

3. The nail polish applicator as in claim 1, wherein the compressor comprises at least two protrusions disposed opposite each other on the cap.

4. The nail polish applicator as in claim 1, wherein the air suction unit comprises a rubber bladder.

5. The nail polish applicator as in claim 1, wherein the cap comprises a receiving hole for receiving said at least one protrusion.

6. The nail polish indicator as in claim 1, wherein said at least one compressor comprises a u-shaped bracket.

7. The nail polish applicator as in claim 1, wherein further comprising at least one suction inlet coupled to the storage body.

8. The nail polish applicator as in claim 1, wherein the leaf spring is coupled to the cap and is positioned flush along an outer surface of the cap.

9. The nail polish applicator as in claim 1, wherein said at least one protrusion is shaped in a cylindrical manner.

10. The nail polish applicator as in claim 1, wherein the compressor comprises a u-shaped bracket having said protrusions positioned on each end of the bracket wherein said u-shaped bracket is positioned on an outside region of the cap.

* * * * *